US006343385B1

(12) United States Patent
Katz

(10) Patent No.: US 6,343,385 B1
(45) **Date of Patent: *Feb. 5, 2002**

(54) IMPACT ABSORBING PROTECTIVE APPARATUS FOR THE FRONTAL, TEMPORAL AND OCCIPITAL BASILAR SKULL

(76) Inventor: Jeffrey P. Katz, 11809 Blue February Way, Columbia, MD (US) 21041

( * ) Notice: Subject to any disclaimer, the term of this patent is extended or adjusted under 35 U.S.C. 154(b) by 0 days.

This patent is subject to a terminal disclaimer.

(21) Appl. No.: 09/495,357

(22) Filed: Feb. 1, 2000

Related U.S. Application Data

(63) Continuation-in-part of application No. 09/072,048, filed on May 5, 1998, which is a continuation of application No. 08/759,120, filed on Dec. 2, 1996, now Pat. No. 5,745,923.

(51) Int. Cl.[7] ..... A42B 3/00
(52) U.S. Cl. ..... 2/411; 2/410; 2/425; 2/412
(58) Field of Search ..... 2/411, 410, 412, 2/421, 425, 2.5, 465; 428/318.6, 71, 319.9, 316.6

(56) References Cited

U.S. PATENT DOCUMENTS

| | | | | | |
|---|---|---|---|---|---|
| 3,304,219 | A | * | 2/1967 | Nickerson | 428/71 |
| 3,555,561 | A | * | 1/1971 | Neis | 2/425 |
| 4,011,611 | A | * | 3/1977 | Lederman | 5/655.4 |
| 4,343,047 | A | * | 8/1982 | Lazowski et al. | 2/411 |
| 4,432,099 | A | * | 2/1984 | Grick et al. | 2/412 |
| 4,472,472 | A | * | 9/1984 | Schultz | 428/178 |
| 4,905,320 | A | * | 3/1990 | Squyers, Jr. | 2/22 |
| 5,134,725 | A | * | 8/1992 | Yeshurun et al. | 2/2.5 |
| 5,177,815 | A | * | 1/1993 | Andujar | 2/411 |
| 5,481,762 | A | * | 1/1996 | Gentes et al. | 2/411 |
| 5,669,079 | A | * | 9/1997 | Morgan | 2/414 |
| 5,718,968 | A | | 2/1998 | Cutler et al. | 428/218 |
| 5,745,923 | A | * | 5/1998 | Katz | 2/411 |
| 5,916,672 | A | * | 6/1999 | Reeves et al. | 428/319.9 |

* cited by examiner

*Primary Examiner*—Gloria M. Hale
(74) *Attorney, Agent, or Firm*—Nath & Associates PLLC; Gary M. Nath; Marvin C. Berkowitz

(57) ABSTRACT

A helmet for protection against non-motorized injuries comprises a number of arched segments with ventilation spaces between them, the arched segments being shaped to extend about and engage the skull. The helmet is constructed to cover the apical as well as the frontal, temporal and occipital basilar skull. The arched segments are convex on their outer surfaces, have flat, curved inner surfaces, and are made of a cushioning, impact absorbing material such as plastic foam. Reinforcing elements extend in longitudinal passages in the arched segments to provide resistance against forces which are only partly absorbed by the cushioning material. In an alternate embodiment, support straps extend over the apical skull, and an impact resistant helmet is worn over the apical skull.

18 Claims, 6 Drawing Sheets

IMPACT ABSORBING PROTECTIVE APPARATUS FOR THE FRONTAL, TEMPORAL AND OCCIPITAL BASILAR SKULL

This application is a continuation-in-part application of U.S. patent application Ser. No. 09/072,048 May 5, 1998, which is a continuation application of Ser. No. 08/759,120 now U.S. Pat. No. 5,745,923 filed on Dec. 2, 1996, the entire contents of the application and patent of which are hereby incorporated in their entirety.

BACKGROUND OF THE INVENTION

1. Field of the Invention

The present invention relates to protective head pieces, particularly light weight helmets or helmet shell liners for non-motorized activities.

2. Brief Discussion of the Prior Art

There has long been a need for a lightweight, economical, comfortable, but very effective safety helmet for non-motorized sports enthusiasts. Non-motorized sports activities include bicycling, skiing, and hockey, for example. In these activities, the velocity of impact is less than in motorized vehicle activities, such as automobile travel, snow mobiles, and motor boats. Since the force delivered by an impact is proportional to the square of the impact velocity, impacts from non-motorized activities are substantially smaller, but nevertheless can cause significant skull injury.

Numerous medical journal articles recite typical traumatic injuries to the head which result from bicycle accidents. Specifically, Kitchens, J. L., Groff, D. B.; Basilar Skull Fractures in Childhood with Cranial Nerve Involvement, J. Pediatr. Surg. Aug. 26, 1991 (8); 992–4, and McGuirt and Stook (Temporal Bone Fractures in Children: A Review With Emphasis on Long Term Sequelae, Clinical Pediatrics, January, 1992, page 12) noted that basilar skull fractures may occur in as much as 14% of head injuries in children. West et al (Transsphenoid Basilar Skull Fracture: CT Patters", Neuroradiology, August, 1993, page 329) noted that basilar skull fracture complications in 40 patients included 11 deaths, blindness, cranial nerve injury, CSF (leakage of cerebrospinal fluid), hearing loss and other such injuries.

Published data indicates that of individuals wearing helmets, most impacts occurred on areas of helmets not tested during certification to a standard. All serious head injury occurred when either the helmet; a) came off the wearer's head, b) collapsed due to a structural defect in the helmet, or c) was struck predominantly below the rim. Current standards fail to identify the basilar skull as requiring protection: see "Standard Test Methods for Equipment and Procedures Used In Evaluating the Performance Characteristics of Protective Headgear", American Society for Testing and Materials, designations F 1446–95; "Standard Specification for Protective Headgear Used in Bicycling", American Society for Testing and Materials, designations F 1446–94; Australian Standard (AS 1986), U.S. Snell (Snell 1984), and ANSI-Z90.4 (ANSI 1984).

U.S. Design Pat. No. 336,552 to Timms et al shows a crossbar over the top opening of the helmet. U.S. Pat. No. 3,425,061 to Webb discloses an outer protective shell arranged over a layer of energy absorbing material and an additional inner protective layer; forming ribs integrally and extending the layers transversely across each other provides energy absorption.

U.S. Pat. No. 5,088,130 to Chiarella discloses a plastic outer shell with a shock absorbent molded inner layer and a chin strap.

The helmets disclosed in the above patents and other helmets known in the prior art fail to provide protection to the frontal, temporal and occipital basilar skull, and fail to provide a helmet structure which is both shock absorbing and protective of the skull against impact forces.

SUMMARY OF THE INVENTION

A helmet is provided which is particularly for protection of the skull, including protection against injury to the apical as well as the basilar skull including frontal, temporal and occipital portions, in order to protect the skull in accidents, particularly from non-motorized sport activities. The helmet comprises a number of arched segments, each of which has an outer convex surface and an inner, substantially flat surface for engaging a generally curved surface of the skull. The segments are of cushioning material which are capable of yielding under impact forces to absorb some of the energy of these forces; it is preferably of a suitable plastic foam material made from beads such as expanded polypropylene beads or polymeric beads. In a preferred embodiment of the invention the cushioning material is made of two or more layers of deformed beads. In another embodiment within each segment there is a longitudinally extending hollow passage in which there is a relatively stiff plastic reinforcing element to resist impact on the skull from forces which are partly absorbed by the cushioning material of the segments. The helmet also includes a retaining element for engaging the chin of the wearer, the retaining element extending from the occipital and temporal areas. In an alternative embodiment, the protective helmet may include only arched segments beginning at the basilar skull, and extending downwardly, with support straps extending over the cranium and connected to the arched segments, in order to receive on the cranium of the wearer a detachable, impact resistant helmet.

Among the objects of the present invention are to provide a helmet for absorbing impacts from non-motorized sports, falls, etc. which effectively reduces or minimizes injury to the skull including the frontal, temporal, and occipital basilar skull.

Another object of the present invention is to provide a helmet which will protect against injuries to the areas below the test lines designated in current standard specifications for helmets.

Yet another object of the present invention is to provide a helmet which protects the human skull against injury by both force absorbing and impact resisting elements.

It is yet another object of the invention to provide a protective head piece that is economical and simple to manufacture.

These and other objects of the invention will be apparent from the following drawings and detailed description of the invention.

BRIEF DESCRIPTION OF THE DRAWINGS

The present invention will be fully understood by reference to the following drawing figures wherein.

DETAILED DESCRIPTION OF THE PREFERRED EMBODIMENTS

Figure 1:
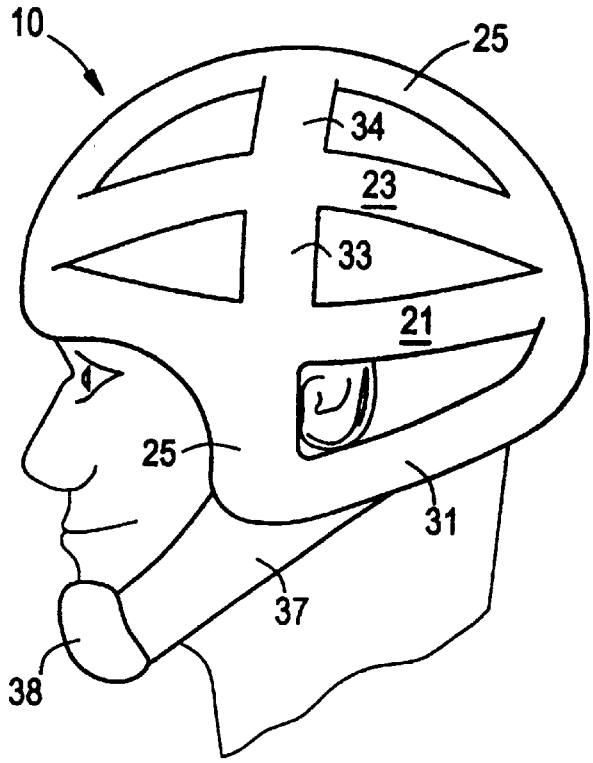
FIG. 1 is a side view of a helmet in accordance with the present invention on a person's head.

Referring now to the drawings wherein like or corresponding reference numerals are used for like or corresponding parts throughout the several views, there is shown in FIG. 1 a helmet 10 in accordance with the present invention in place on a human head H. The helmet comprises a plurality of arched segments 20 which extend over and about the skull. As shown best in FIG. 2, there is a left temporal segment 21 and a right temporal segment 22 which merge at the front of the helmet, passing about the skull at or just over the eyebrows, and the segments 21 and 22 also merge at the occipital region of the skull.

Figure 3:
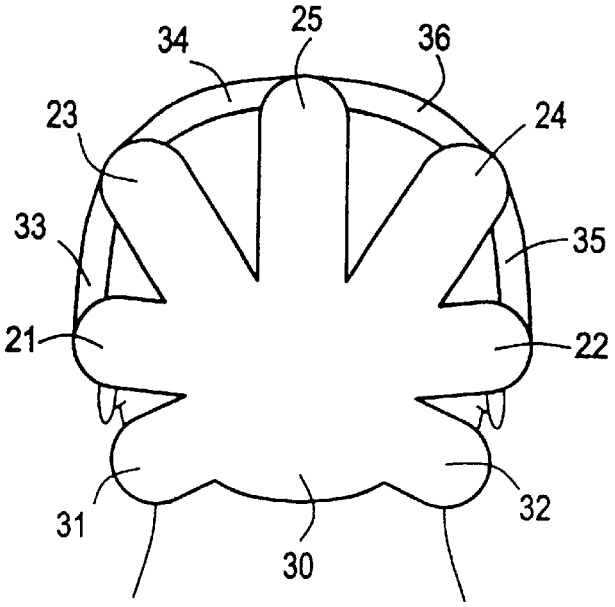
FIG. 3 is a view taken from the rear of FIG. 1.

A central cranial segment 25 extends from the front of the segments 21 and 22 over the crown of the skull and is joined at the juncture region 30 (FIG. 3). Between and spaced from the segments 21 and 25 is a left median segment 23, and between the central segment 25 and the right temporal segment 22, and generally spaced from them is a right median segment 24.

Extending from the juncture region 30 there is a left basilar segment 31 and a right basilar segment 32, these segments extending somewhat downwardly and towards the mandibular region, covering the lower parts of the ears. The forward end of the left basilar segment 31 (FIG. 2) merges with and is joined to a left sub-temporal segment 26 extending downwardly from the left temporal segment 21, and the right basilar segment 32 merges with and is joined to a right sub-temporal segment 27 extending downwardly from the right temporal segment 22. A lower left cranial segment 33 and an upper left cranial segment 34 extend between the left temporal segment 21 and the left median segment 23, and between left median segment 23 and central segment 25 a respectively. As shown in FIG. 3, lower right cranial segment 35 extends between right temporal segment 22 and right median segment 24, and upper right cranial segment 36 extends between right median segment 24 and central segment 25.

A chin strap 37, as shown in FIG. 1, descends from the left basilar segment 31, and a similar chin strap (not shown) descends from the right basilar segment 32. These chin straps 37 are connected by a suitable fastener, such as a buckle, and one or both of the chin straps 37 may be provided with a chin cushion 38. The chin strap secures the helmet 10 on the head and serves to retain it against becoming dislodged. The chin strap 37 descends from the temporal and occipital regions of the helmet, without obstructing the ears of the wearer. Further, the segments are light-reflective, as by having a suitable coating on their outer surfaces.

Figure 2:
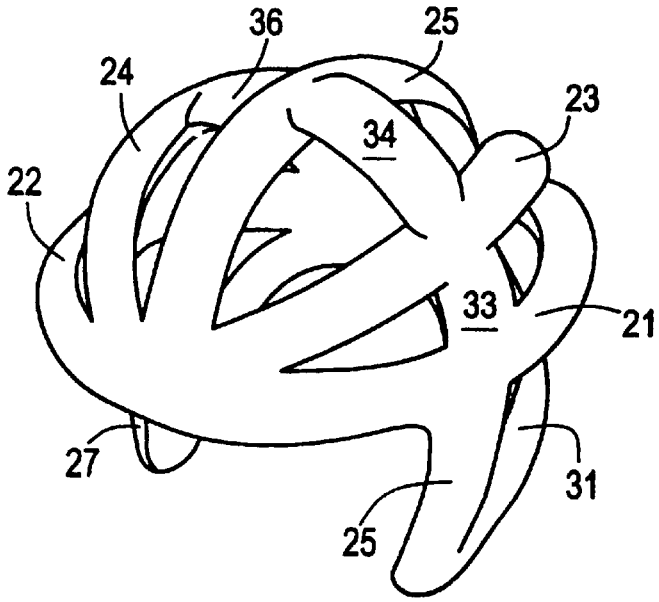
FIG. 2 is a perspective view of the helmet of FIG. 1, with parts removed.

As shown in FIGS. 2 and 3 in particular, the segments are spaced apart to provide for ventilation, the width of a segment being approximately two inches, for example, with spacing between them of about one inch at the region of maximum spacing. Thus, adequate ventilation is provided to dissipate heat and achieve a reasonable level of comfort while protecting the wearer.

Figure 4D:
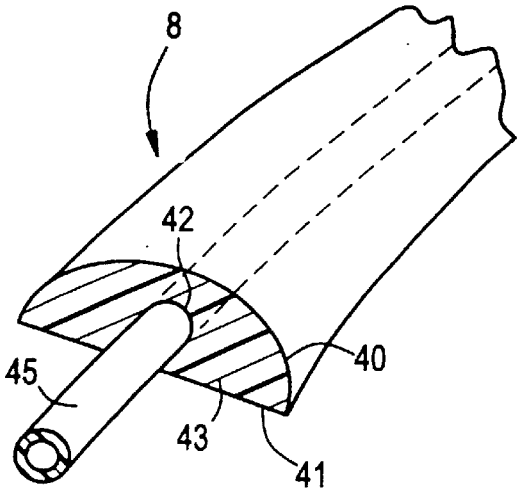
FIG. 4D is an exploded view of an embodiment of a portion of a segment of the helmet of FIGS. 1–3 disclosing a channel located within the segment.
Figure 4A:
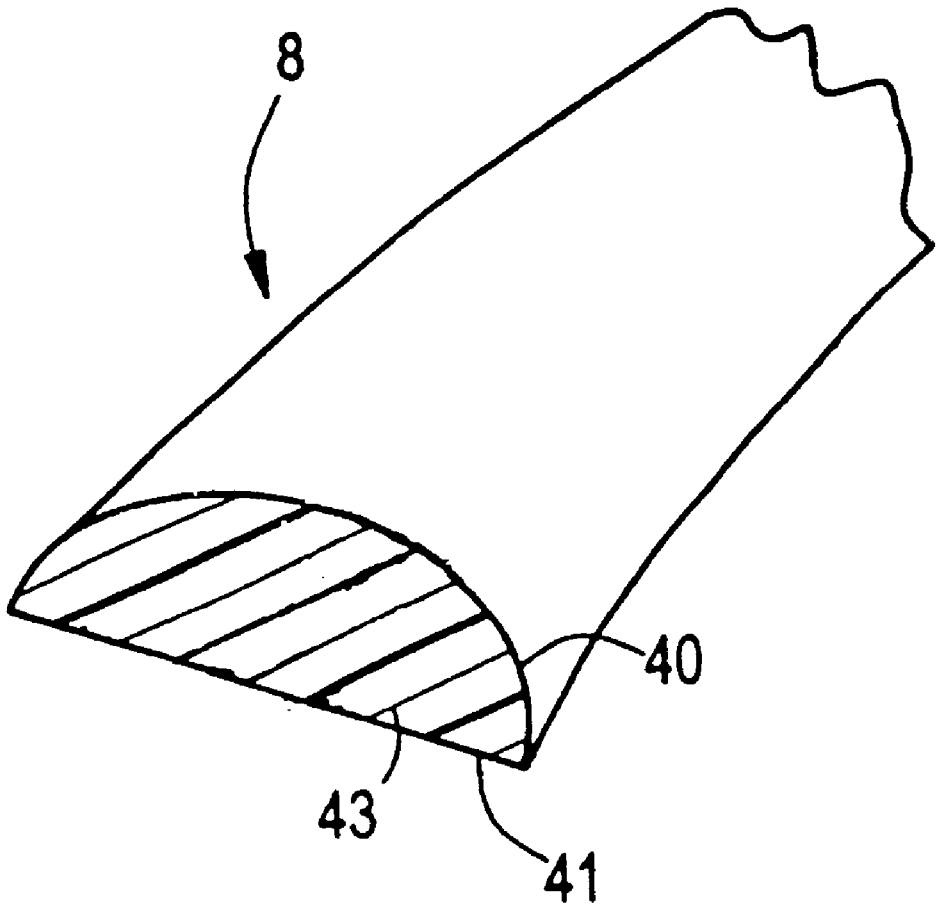
FIG. 4A is an exploded view of a portion of a segment of the helmet of FIGS. 1–3.

As shown in FIG. 4A, which is an exploded perspective view of a portion of a segment 8, which may be any of the segments shown in FIGS. 1–3, is of arched configuration longitudinally, having an outer convex surface 40 and an inner, substantially flat surface 41. The arched segment, illustrated by segment 8 in FIG. 4A, is of cushioning material which is capable of yielding to absorb impact forces.

The cushioning material of the body 43 is preferably of a suitable plastic foam material, which is made from expanded polypropylene, EPAM sponge produced by Lauren Manufacturing Company, New Philadelphia, Ohio. The material is an ASTM D-1056 2AZ, and is sold in bulk footage.

In another preferred embodiment of the present invention, the cushioning material of the body 43 is made of polystyrene. In a particularly preferred embodiment, the cushioning material is made by the following process. In an initial step, commercially available polystyrene beads, each including a surrounding shell and an interior volume filled with a blowing agent, such as pentane, are pre-expanded. This pre-expansion is a conventional, controlled process requiring the application of heat through hot air and/or steam. Heat causes the blowing agent to vaporize and exert vapor pressure on the beads' polystyrene shell. The vapor pressure causes the beads to expand to a desired density, dictated by the heat applied in the expansion process. Upon cooling, the beads have reduced internal pressure due to the condensing of the blowing agent and the volume expansion of the beads.

Conventionally, beads are aged to equilibrate internal pressure with the surrounding atmosphere before molding. However, these pre-expanded beads are preferably immediately (i.e., as soon as practically possible) charged to a mold in the shape of the segments of the present invention, where they are subjected to heat and pressure for molding to a first volume. While such beads are preferred, some benefits of the invention may be obtained from "partially equilibrated" or partially aged beads, as long as the beads are not completely aged or "stale" so that their internal pressure equals atmospheric pressure. The molded segments are then rapidly cooled, in the mold, thereby causing the vaporized blowing agent within the beads to condense and create a pressure less than atmospheric inside the beads. Thereafter, the molded segments with beads having low internal pressure is immediately (i.e., as soon as practically possible) subjected to compression to a second volume, less than the first volume. Because of the reduced pressure inside the beads, the beads will decrease in size by deforming readily and permanently under pressure, theoretically until pressure inside the decreasing volume of the bead equilibrates with applied pressure. There is no significant tendency of the bead, once compressed, to "spring back" to an original, more rounded shape, except at low densities of about 1 lb/ft$^3$. However, when this product is layered, this tendency is reduced or eliminated. Consequently, the compression achieved is permanent. Thus, a volume-stable, high density, high strength, highly impact resistant helmet is formed.

Figure 4B:
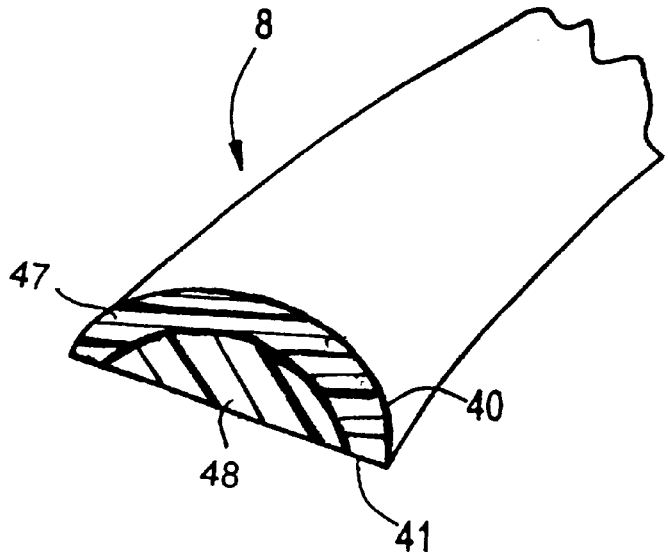
FIG. 4B is an exploded view of an embodiment of a portion of a segment of the helmet of FIGS. 1–3 disclosing a layered segment.

As shown in FIG. 4B, the segments are preferably layered, having at least two layers 47 and 48 of different density. Additional layers are formed, as explained below, by adding beads to the mold after the first molding step, and then molding together the originally-molded with the additional beads. This results in a preferred layered segments, wherein each layer has a different density than other layers and each layer has a density higher than the density of the beads from which it was molded, except when a last layer is a backfill layer of density equal to that of the beads from which it is molded. Preferably, the outermost layer 47 has the highest density to deflect impact force and retain shape, while inner layer 48 has a lower density to absorb impact forces to minimize transmission of these forces through the helmet. The segments preferably have layers, at least one of which has a density at least about 200%, preferably at least about 300%, and most preferably at least about 400% greater than the beads from which it is molded. In one embodiment of the invention the density of outer layer 47 ranges from about 2–5 lbs/ft$^3$ and the density of inner layer 48 ranges from about 1–2 lbs/ft$^3$.

Figure 4C:
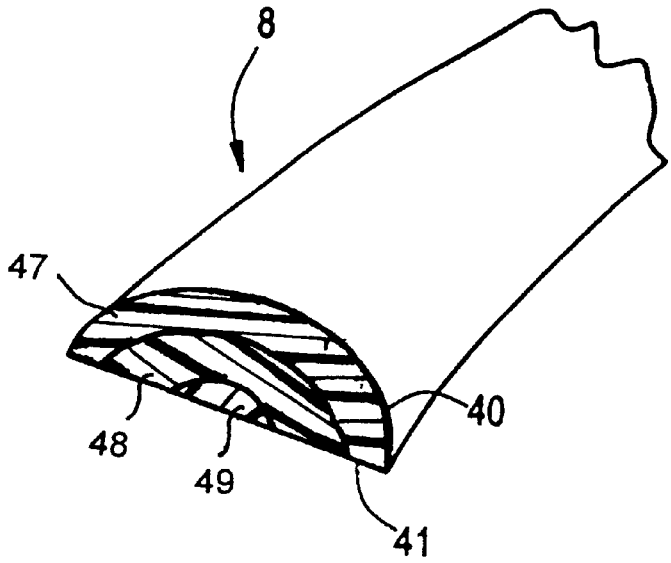
FIG. 4C is an exploded view of an embodiment of a portion of a segment of the helmet of FIGS. 1–3 disclosing a layered segment.

In another embodiment of the invention as depicted in FIG. 4C, layer 47 has the highest density to deflect impact forces and retain shape, while inner layer 48 has a lower density to absorb impact forces to minimize transmission of these forces through the helmet. Finally the inner most layer 49 has the lowest density so that it is pliable enough to conform to a users head.

In a preferred embodiment, a 0.5-inch thick double-layered helmet of the invention, that includes a 0.1875-inch thick layer of 1.89 lb/ft$^3$ density and a 0.3125-inch thick layer of 1.12 lb/ft$^3$, is able to withstand a 25-joule impact without visible damage and returns to its original shape. Preferably, the segments are able to withstand a 30-joule impact, and more preferably a 35-joule impact without such damage and return to its original shape. An assembled layered liner of 0.75-inch thickness is able to attenuate a single 110-joule impact force without fracture and transmit less than 300 Gs. Moreover, the layered segments are able to attenuate two impacts of a 110-joule force without fracture and transmit less than 400 Gs.

The preferred layered segments may have a plurality of layers. Preferably, as explained above, density ranges from highest to lowest from one outermost layer to the opposite outermost layer, but other density-layer arrangements are also useful. For example the outermost layer and the inner most layer may have a high density while the inner layer or layers have a lower density. Preferably, the ratio of density of the most dense to the least dense layer of a construct is in the range of about 50:1.0 to about 1.5:1.0, more about 30:1.0 to about 1.5:1.0, and most preferably about 12:1.0 to about 1.5:1.0. While the relative thickness and densities of the layers depends upon the desired use of the liner, in general, it is preferred that the ratio of thickness of the highest density layer to the lowest density layer be in the range of about 1:1 to about 1:8, more preferably about 1:1 to about 1:5, and most preferably about 1:1 to about 1:3, for applications where thin segments are most useful. In certain application, the segments are not layered. For other specific applications, the ratios of density and thickness may vary from those given above.

While in a preferred embodiment of the invention, the segments are made of polystyrene by the process discussed above, the above process may be used in conjunction with other polymers and plastics to form the segments of the present invention. In addition to polystyrene, the segments may be made from, without limitation, a polypropylene, a polybutylene, a polyvinyl (including polyvinyl chloride), a polyester, a polycarbonate, a polyurethane, a polyamine, a polyacrylic, a polyamide, a polyurea, and any other suitable polymer.

FIG. 4D, is an exploded perspective view of a portion of another preferred embodiment of segment 8, which may be any of the segments shown in FIGS. 1–3. Segment 8 is of arched configuration longitudinally, having an outer convex surface 40 and an inner, substantially flat surface 41. A passage 42 of generally circular transverse cross-section extends through the body 43 of segment 8. The arched segment, illustrated by segment 8 in FIG. 4B, is of cushioning material which is capable of yielding to absorb impact forces.

As discussed earlier the cushioning material of the body 43 is preferably of polystyrene or a suitable plastic foam material.

There is also shown in FIG. 4D a reinforcing element 45 which is of generally cylindrical construction, of a size and shape to fit snugly in the passage 42 of the segment 8, so as to substantially fill it. Reinforcing element 45 is relatively stiff, being made of a rigid or semi-rigid plastic material and is fabricated to resist impact on the skull from forces which are partly absorbed by the cushioning material of the body 43 of segment 8.

Figure 5:
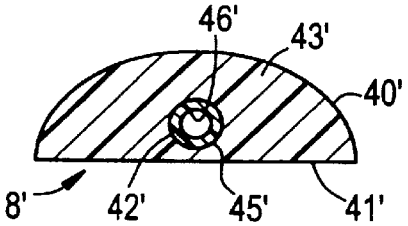
FIG. 5 is an end view of a modified element of the helmet in accordance with FIG. 1.

FIG. 5 is a cross-sectional view of a modified segment 8', segment 8' being wider relative to the height of segment 8, as provided by the somewhat wider outer convex surface 40' and flat arched inner surface 41'. The passage 42' is elliptical in cross-section, as is the reinforcing element 45'. The reinforcing element 45' has a passage 46 extending longitudinally through it, to reduce its resistance to deformation, so as to provide reinforcement, but with greater ability to yield to forces imposed on it through the body 43' of the segment 8'.

Reinforcing element 45, 45', may be of other constructions than that described above. For example, the reinforcing element may be of polystyrene or a suitable plastic foam material. Further, the reinforcing element may be formed as a sealed chamber of pliable material having within it a gas, such as air, under superatmospheric pressure, or constructed as a sealed chamber of pliable material having a gel substantially filling it.

Figure 6:
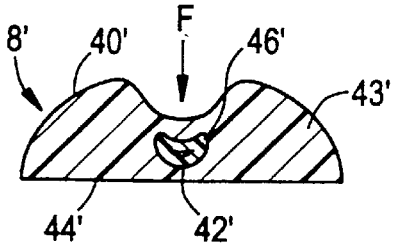
FIG. 6 is an illustration of the action of the structure of FIG. 5 upon receiving an impact force.

FIG. 6 illustrates the result of an external force F applied to the segment 8', the illustration being equally applicable to the segment 8. The force F is received by the body 43' and is shown as being substantially perpendicular to inner surface 41'; however, it is to be appreciated that this is illustrative only, since the force F may be delivered at an angle to the inner surface 41'. Upon the force F being applied, as from engagement of the outer surface 40' with or by an object, the body 43' will yield, absorbing some or all of the energy from the force F. In the event that the force F is so great that the body 43' does not absorb all of the energy of force F, reinforcing element 45' will be deformed, as shown in FIG. 6, and will absorb some or all of the remaining energy, so that there is delivered to the skull which is in engagement with inner surface 41' a force which is much less than the force F which impacted on the outer surface 40'.

Figure 7:
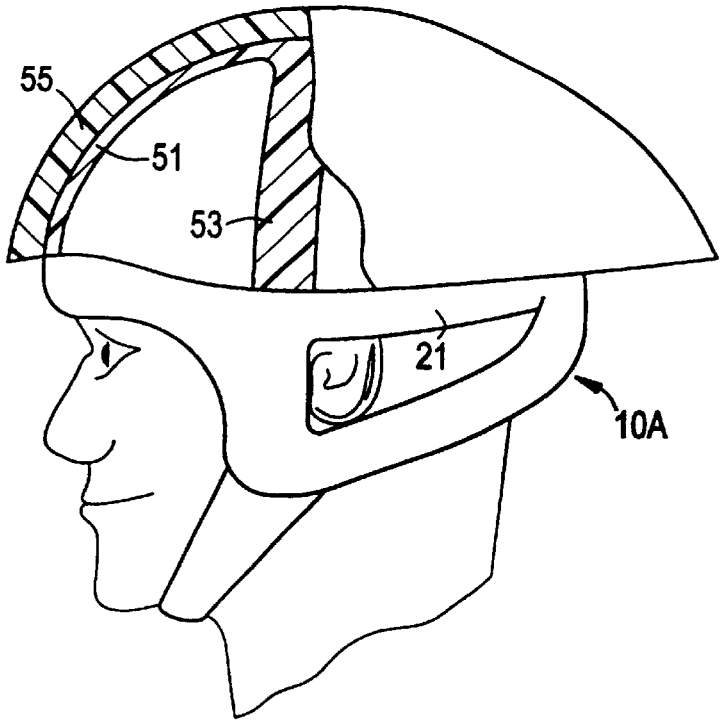
FIG. 7 is a view similar to FIG. 1, with parts in section, showing a helmet of the present invention worn with a bicycle style impact resistant helmet.
Figure 8:
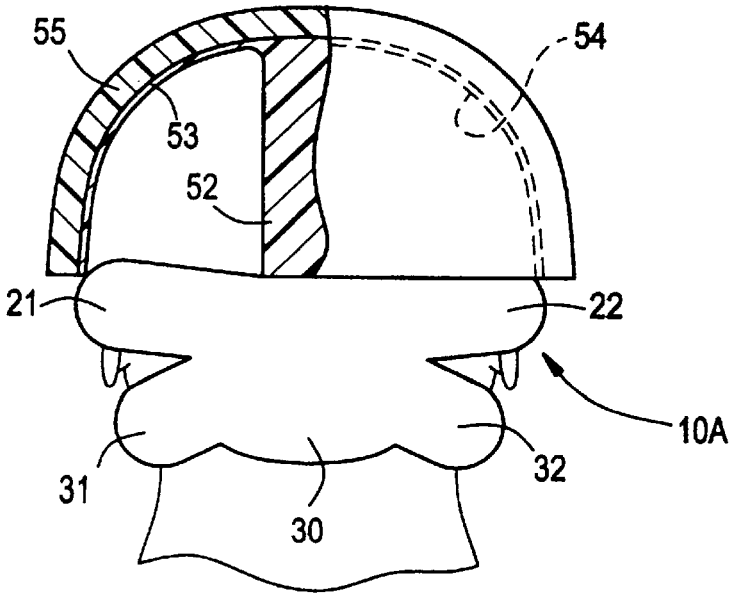
FIG. 8 is a view taken from the rear of FIG. 7, with parts in section.

In FIGS. 7 and 8, there are shown, respectively, side and rear views of a helmet which comprises segments as above discussed which extend about the basilar skull, with straps connected to some of the segments which support the segments on the head and extend over the cranium. A separate protective, impact resistant helmet is placed over these straps. Thus, in FIGS. 7 and 8, there is shown a helmet 10*a* comprising left and right temporal segments 21 and 22 which, as in helmet 10, merge at the front of the helmet at or just over the eyebrows, and also merge at the occipital region of the skull. There may also be seen left basilar segment 31 and right basilar segment 32 which extend to the merger region 30, as in FIG. 1. However, the helmet 10*a* is provided with supporting front strap 51, supporting rear strap 52, supporting left side strap 53 and supporting right side strap 54. These supporting straps extend over the cranium, preferably from front to back and from side to side, as shown. An impact resistant helmet 55 such as a bicycle helmet is placed over the cranium and over the support straps 51, 52, 53 and 54. Helmet 55 extends to adjacent the arched segments 21 and 22, and being an impact resistant helmet, may be removed for the comfort of the wearer when appropriate. The helmet 55 may be attached by appropriate fasteners or the like 56 so as to remain in place on the cranium of the wearer.

Figure 9:
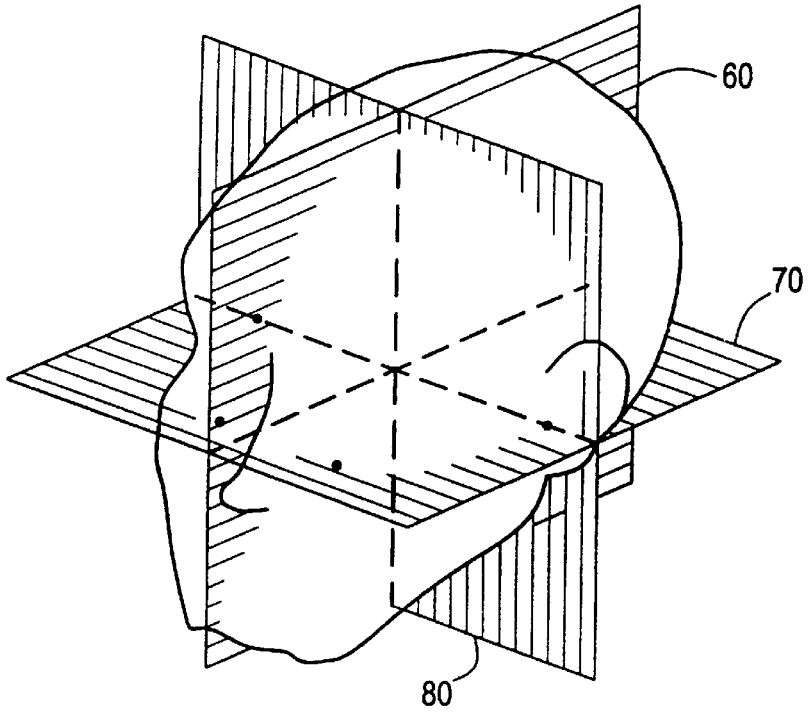
FIG. 9 is a view illustrating the major anatomical planes of the human head.
Figure 10:
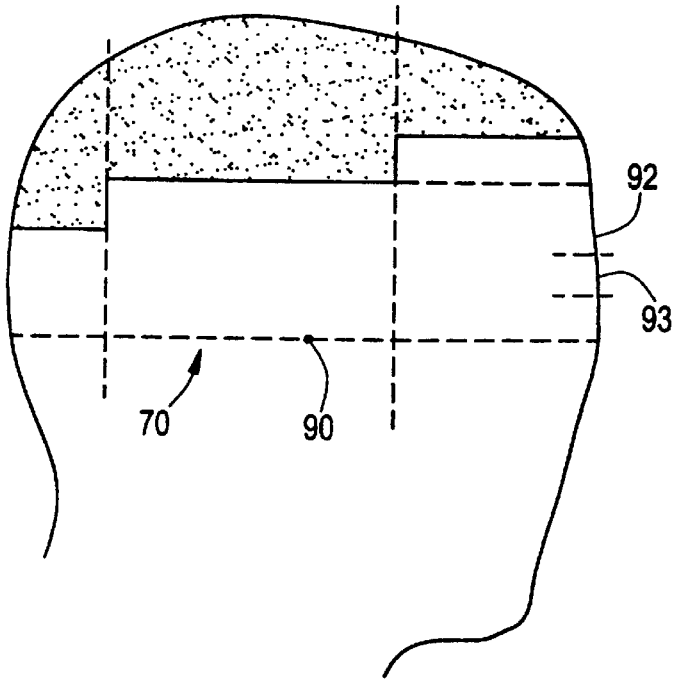
FIG. 10 is a diagram of major anatomical planes of the human head.

Referring to FIGS. 9 and 10, there is provided a discussion of the relationship of the construction of helmet 10 to the anatomy of a human skull and how the helmet 10 protects all parts of the skull including frontal, temporal and occipital basilar skull.

In FIG. 9, there are shown the major anatomical planes of the skull, these being the basic plane 70, the midsagittal or longitudinal plane 60, and the coronal or transverse plane 80.

The basic plane 70 is the anatomical plane which includes the superior rims of the auditory meatuses, the upper edges of the external openings at the ears, and the notches of the interior orbital ridges at the bottom edges of the eye sockets.

The midsagittal plane 60 is perpendicular to the basic plane and passes through (a) the mid point of the line connecting the notches of the right and left inferior orbital ridges at the bottom edges of the eye sockets, and through (b) the mid point of the line connecting the superior rims of the right and left auditory meatuses at the upper edges of the external openings of the ears.

The coronal plane 80 is perpendicular to both the basic plane 70 and the midsagittal plane 60 and passes through the mid point of a line connecting the superior rims of the right and left auditory meatuses.

Turning now FIG. 10, there is shown a human skull with the midsagittal longitudinal plane 60, which passes through the center of the auditory meatuses 90. The forehead or frontal region of the skull 92 is indicated, the eye sockets being indicated at 93. The shaded area on the skull is the area or region of the skull which is intended to be protected by the above noted current standard specification for helmets referenced hereinabove, i.e., principally the cranial region of the skull. Thus, these standards fail to require helmets which protect the basilar skull, comprising the forehead or frontal part of the skull, the sides or temporal portions of the skull, and the back or occipital portion of the skull. In contrast, as is clearly apparent from FIGS. 1–3 and 7 and 8, the helmets of the present invention protects these regions, as well as the crown region of the skull. These helmets meet the noted standards for protective helmets.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

I claim:

1. A helmet shell liner for a human head comprising, a plurality of longitudinal arched shaped segments for encircling the frontal temporal and occipital basilar skull of a human head;

said plurality of longitudinal arched shaped segments merged integrally in a common occipital region.

2. A helmet shell liner for a human head as claimed in claim 1, wherein said cushioning material comprises at least an outer layer of deformed polymeric beads and an inner layer of deformed polymeric beads.

3. A helmet shell liner for a human head as claimed in claim 2 wherein said outer layer has a density allowing for the deflection of impact forces and retention of the shape of said outer layer, and said inner layer has a density allowing for the absorption of impact forces and allowing said inner layer to conform to the human head.

4. A helmet shell liner for a human head as claimed in claim 2 wherein said outer layer has a density ranging from 2–5 lbs/ft$^3$ and said inner layer has a density ranging from 1–2 lbs/ft$^3$.

5. A helmet shell liner for a human head as claimed in claim 2 wherein said deformed polymeric beads of each layer are fused to adjacent beads within said layer and each layer is fused to an adjacent layer in situ to form a continuous body of said arched shaped segment.

6. A helmet shell liner for a human head as claimed in claim 2 wherein said polymeric beads are selected from the group consisting of polystyrene beads, polypropylene beads, polybutylene beads, polyvinyl beads, polyester beads, polycarbonate beads, polyurethane beads, polyamine beads, polyacrylic beads, polyamide beads, polyurea beads, and mixtures thereof.

7. A helmet shell liner for a human head as claimed in claim 2 wherein said polymeric beads are polystyrene beads.

8. A helmet shell liner for a human head as claimed in claim 1 further comprising a fastener connecting said longitudinal arched shaped segments to a helmet shell.

9. A helmet shell liner for a human head as claimed in claim 8 wherein said fastener fastens only portions of said longitudinal arch shaped segments located toward a base of said helmet shell liner.

10. A helmet shell liner for a human head as claimed in claim 1 wherein each of said longitudinal arch shaped segments has a hollow passage extending longitudinally therein and a relatively stiff reinforcement element is located in said passage of each said longitudinal arch shaped segment.

11. A helmet shell liner for a human head as claimed in claim 10 wherein said relatively stiff reinforcement element is an inflated bladder.

12. A helmet shell liner for a human head as claimed in claim 10 wherein said relatively stiff reinforcement element is a solid material.

13. A helmet shell liner for a human head as claimed in claim 10 wherein said relatively stiff reinforcement element is a non-solid material.

14. A helmet shell liner for a human head as claimed in claim 1 further comprising at least one transverse arched shaped segment connected between adjacent ones of said plurality of longitudinal arched shaped segments.

15. A helmet shell liner for a human head as claimed in claim 1 further comprising at least one longitudinal strap connected at a first end thereof to said common occipital region, and connected at a second end thereof to a common frontal region; and at least one transverse strap connected at a first end thereof to one of said plurality of longitudinal arched shaped segments, and connected at a second end thereof to another of said plurality of longitudinal arched shaped segments.

16. A helmet shell liner for a human head as claimed in claim 11 wherein said bladder is inflated with a gas.

17. A helmet shell liner for a human head as claimed in claim 11 wherein said bladder is inflated with a liquid.

18. A helmet shell liner for a human head as claimed in claim 17 wherein said liquid is a gel.

* * * * *

UNITED STATES PATENT AND TRADEMARK OFFICE

CERTIFICATE OF CORRECTION

PATENT NO. : 6,343,385 B1
DATED : February 5, 2002
INVENTOR(S) : Jeffrey P. Katz It is certified that error appears in the above-identified patent and that said Letters Patent is hereby corrected as shown below:

Column 8,
Line 6, before period insert:
-- each of said arched shaped segments further comprising a cushioning material capable of yielding to absorb impact forces, said cushioning material having at least an inner layer and an outer layer, a density of said inner layer being different than a density of said outer layer --

Lines 14-16, change "wherein said cushioning material comprises at least an outer layer of deformed polymeric beads and an inner layer of deformed polymeric beads" to
-- each of said inner layer and said outer layer further comprising deformed polymeric beads --

Signed and Sealed this

Eighteenth Day of June, 2002

*Attest:*

*Attesting Officer*

JAMES E. ROGAN
*Director of the United States Patent and Trademark Office*